US005396991A

United States Patent [19]

Lachambre

[11] Patent Number: 5,396,991

[45] Date of Patent: Mar. 14, 1995

[54] YARN SPOOL HOLDING TRAY

[76] Inventor: Patrick R. Lachambre, 348 Victoria Avenue, Regina, Saskatchewan, Canada, S4N 0P6

[21] Appl. No.: 148,331

[22] Filed: Nov. 8, 1993

[51] Int. Cl.[6] ..... B65D 85/676

[52] U.S. Cl. ..... 206/392; 206/493; 206/565

[58] Field of Search ..... 206/225, 227, 49, 391, 206/392, 393, 394, 53, 408, 493, 565, 557, 558

[56] References Cited

U.S. PATENT DOCUMENTS

| | | | |
|---|---|---|---|
| 267,232 | 11/1882 | Leonard | 206/391 |
| 380,174 | 3/1888 | Bowles | 206/391 |
| 1,456,401 | 5/1923 | Powell | 206/391 X |
| 2,474,337 | 6/1949 | Sutherland et al. | 206/392 X |
| 3,127,018 | 3/1964 | McMasters . | |
| 3,207,394 | 9/1965 | Claridge | 206/227 X |
| 3,283,892 | 11/1966 | Rosen . | |
| 3,730,340 | 5/1973 | Neubert nee Preischl | 206/392 |
| 4,287,987 | 9/1981 | Hoffman et al. | 206/227 X |
| 4,819,794 | 4/1989 | Silverstein et al. | 206/391 X |
| 5,040,708 | 8/1991 | Blair et al. | 206/391 X |

FOREIGN PATENT DOCUMENTS

| | | |
|---|---|---|
| 514541 | 7/1955 | Canada . |
| 517108 | 10/1955 | Canada . |
| 645745 | 7/1962 | Canada . |
| 881936 | 9/1971 | Canada . |

*Primary Examiner*—Jacob K. Ackun, Jr.
*Attorney, Agent, or Firm*—Adrian D. Battison; Stanley G. Ade; Murray E. Thrift

[57] ABSTRACT

A holding tray for spools of yarn suitable for embroidery machines comprises a molded body forming a flat horizontal base and a plurality of upstanding vertical pegs each of which is generally frustoconical in shape. At the top of each peg is formed a slit diametrically of the top surface and extending a small distance down the side surface of the peg at each side. An end of the yarn from the spool can then be engaged into the slit and the spool engaged over the peg as a loose fit. The pegs thus store twelve spools in two rows of six so that the spools can be carried from a storage area to, for example, a twelve head embroidery machine.

6 Claims, 2 Drawing Sheets

YARN SPOOL HOLDING TRAY

BACKGROUND OF THE INVENTION

This invention relates to a yarn spool holding tray which is particularly but not exclusively designed for holding spools of yarn arranged for use with commercial embroidery machines or the like.

Commercial embroidery machines generally have a plurality of heads simultaneously operating to effect an embroidery action on a base fabric. Each head is supplied with yarn from a plurality of different yarn spools so that the head can switch from yarn color to yarn color by selecting one of the needles at the yarn head. Each needle is threaded with a respective one of the yarn colors. In a commercially popular arrangement, the machine has twelve heads with each head having six needles each associated with a respective yarn color. Each machine therefore has a yarn supply totaling 72 yarn spools which must be managed by the operator to ensure a continuing supply of the required colors. Other machines are also available from one head to six heads and up to twenty four heads.

In addition, it will of course be appreciated that yarn is supplied in many more colors than the simple six colors available at the machine head. It is necessary therefore in any embroidery machine operation to store and manage a very large number of spools of the different colors. Each embroidery machine. Operation therefore has a stock room containing a very large number of spools of different colors with each color having at least twelve spools, one for each head, and generally more since it is necessary of course to have a reserve supply.

The management and control of this spool supply is extremely difficult and constitutes a major problem in the embroidery business.

The spools are of different designs and arrangements depending upon the particular yarn supplier. In general, however, each spool of yarn includes a base support cone on which the yarn is wound. The base support cone is conical in shape so as to allow the yarn to be pulled off over end of the cone in conventional manner.

While yarn spools of this type are relatively stable, mishandling can of course damage the spool by partially or wholly unwinding the structure of the wound yarn package and if this occurs, the whole of the yarn of that spool may become wasted or at least a part of the spool may be unwound and discarded. Such damage can occur if the spools are mishandled by being carried manually as a bundle of the spools or by being dropped or the like.

Canadian Patents 517,108 (Russell), 514,541 (Storer) and 645,745 (Ellis) disclose various forms of support tray having projections from the tray which project into a spool as a friction fit with the spool for use in packing the yarn packages for transportation. These devices are intended to be simple inexpensive elements used in packing and not suitable for permanent storage of spools of different sizes.

Canadian patent 881,936 (Cosentino) discloses a yarn spool storage device in the form of a cabinet with a pair of inclined surfaces each of which has a plurality of outstanding pegs onto which a yarn spool can be attached. This arrangement is however intended for spools of copper wire in the wire industry and is entirely unsuitable for storing yarn spools in a manner which renders them readily for use at for example a twelve head embroidery machine.

U.S. Pat. No. 3,127,018 (McMasters) discloses a wire element for supporting a yarn package. U.S. Pat. No. 3,283,892 (Rosen) discloses a packaging system for yarn and the like which includes a box for transportation with the main feature including a sleeve for protecting the package material.

However none of these devices is in any way suitable for storing and supplying yarn particularly for a yarn embroidery machine.

SUMMARY OF THE INVENTION

According to the invention, therefore, there is provided a yarn spool holding tray comprising a generally horizontal planar base for resting on a support surface, a plurality of pegs upstanding from the base at spaced positions across an upper surface of the base and a plurality of catch means each associated with a respective peg and arranged for receiving and holding an end portion of yarn from a respective one of the spools carried on the peg.

Preferably the catch means comprises a transverse slit formed at the top of the peg and defined by cutting through the material of the peg. This catch acts therefore to grasp the end of the yarn to hold the yarn to prevent any unwinding or tangling of the yarn.

Preferably the use of a simple frustoconical loose fit peg allows the tray to be used for various different types of yarn supply cones since different yarn suppliers use different support cones for their material. It is therefore desirable that the tray be usable with different types of support cone.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
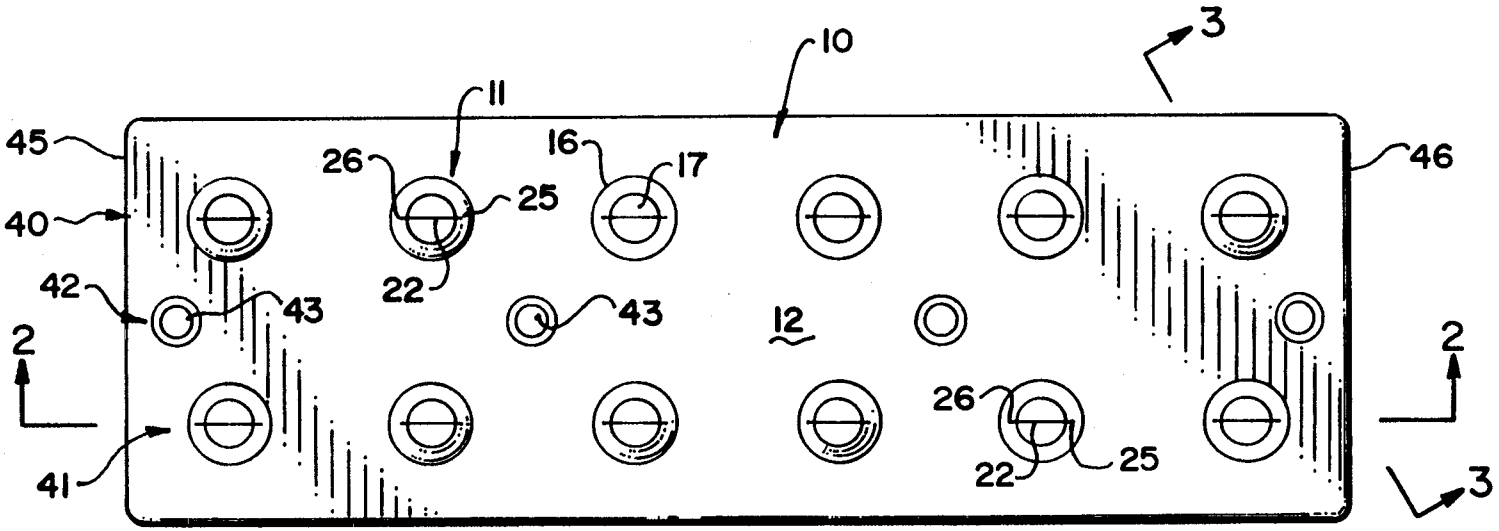
FIG. 1 is a top plan view of the yarn spool holder tray according to the present invention.

The tray of the present invention comprises a horizontal planar base portion 10 and a plurality of pegs 11 upstanding from the base.

The base and the pegs are integrally molded from plastics material so as to form a top surface 12 of the base, a bottom surface 13 of the base and four side edges 14 of the base thus defining a rectangular hollow area bounded by those elements. The bottom surface 13 is flat and rectangular in plan view for resting upon a support surface. The top surface 12 is substantially planar and the pegs 11 are integrally formed with the top surface so as to extend upwardly therefrom. Thus the hollow space 15 to indicate through the hollow interior of the base and up also into the pegs. The thickness of the wall forming the base and the pegs is substantially constant. This construction can be formed by various different molding techniques but in an initial preferred simple technique, the device is manufactured by rotational molding and this acts to form a hollow body of the type defined.

The pegs are frusto-conical in shape extending from a circular base 16 to a circular top surface 17. The top surface is substantially flat so that it is parallel to the surface 12.

The pegs are arranged in an array of two rows of six pegs making a total of 12 pegs which is convenient for a 12 head embroidery machine previously described. The pegs are spaced by a sufficient spacing to receive substantially largest of the types of yarn spools which are used conventionally with embroidery machines. This of course allows smaller type spools to be received also on the pegs. The relative diameters of the bottom edge 16 and top edge 17 of the pegs are arranged so as to receive the spools generally indicated at 20 as a sliding fit. There is no intention, therefore, that the spools be wedged onto the pegs but simply they slide in place and are held by gravity. The length of the pegs is sufficient to prevent the loosely placed spools from toppling. It is of course not intended that the spools be held in place should the tray be inverted or turned through 90° but this is not intended as the tray is arranged to carry the spools while the base remains substantially horizontal.

Figure 3:
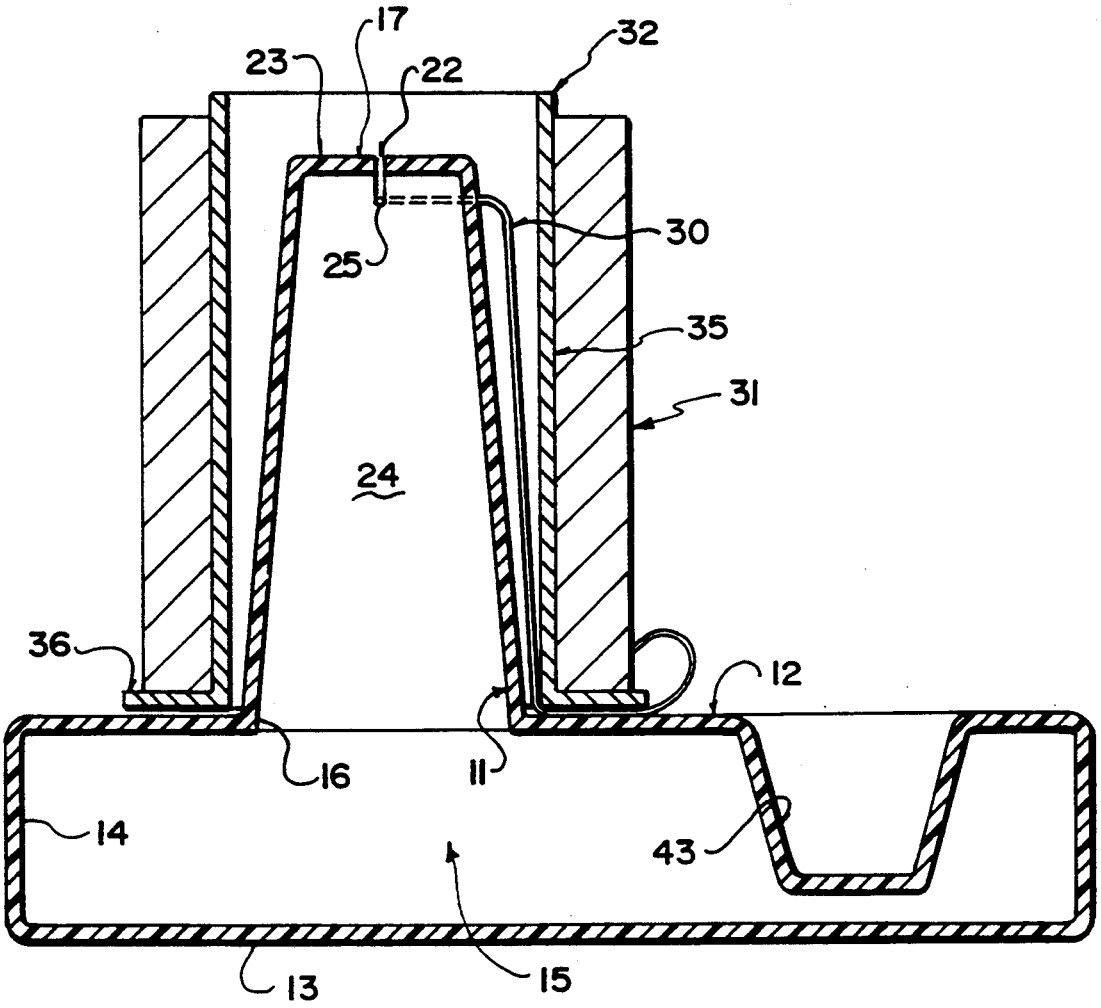
FIG. 3 is a cross sectional view along the lines 3—3 of FIG. 1 showing an alternative form of spool on one of the pegs.

As shown in FIG. 3, each of the pegs includes a transverse cut slit 22. The cut slit is formed without removing any material from the peg simply by cutting across the peg at the top end 17. Thus each slit 22 extends across the top surface indicated at 23 and partly down the side wall indicated at 24 of the peg. Thus the slit extends from an end 25 visible in FIG. 3 to a second end 26 at the same height of the end 25 on the side wall 24. In practice the slit extends across the full extent of the top surface 23 diametrically of the top surface and extends down the side wall 24 to a distance of the order of ¼ inch. A jig is provided to provide accurate cutting of the pegs to the required depth. The slit can extend longitudinally of the tray as shown or more preferably the slits are arranged such that each extends across the respective peg in a direction transverse to the length of the tray.

The slit 22 acts as a catch for an end portion 30 of the yarn from a yarn supply 31 carried on a spool 32 as shown in FIG. 3. Thus in practice the free end of the yarn on the spool is located by the user and before the spool is placed on the tray, the free end is engaged into the slit 22 by holding the end and a portion adjacent the end and by pulling the end across the top surface of the peg. When the end is located, the spool is then placed onto the respective peg. In this way the ends of the yarn are properly held and are not loose for unwinding or tangling. When the spool is removed, a simple pulling of the spool away from the tray will cause the yarn end to be extracted from the slit 22.

Figure 2:
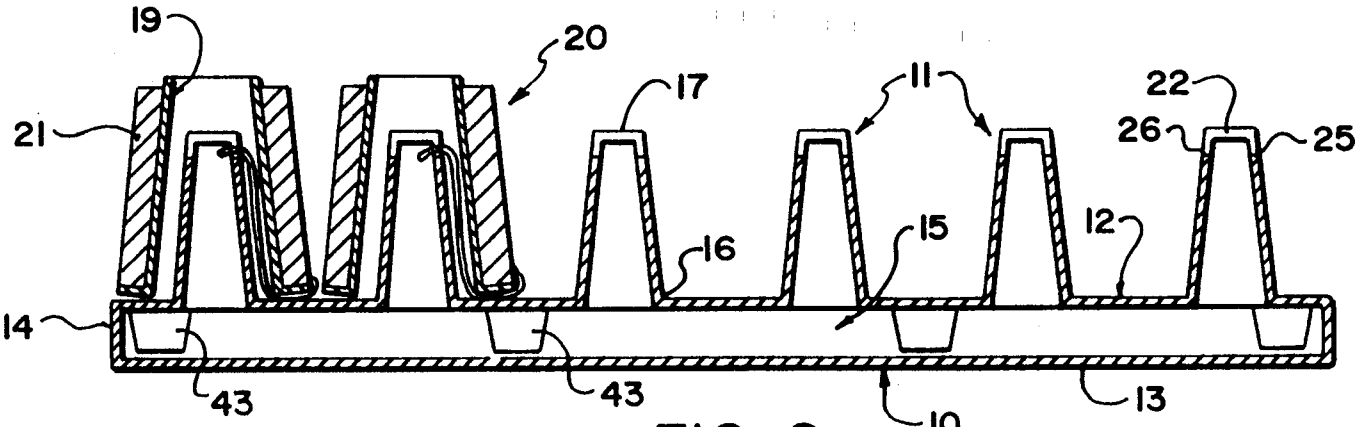
FIG. 2 is a cross sectional view along the lines 2—2 of FIG. 1 showing spools in place on the pegs of the holder tray, only some of the spools being illustrated for convenience of illustration.

Two different sorts of spool are shown in FIGS. 2 and 3. In FIG. 2 there is a simple cone shape spool with a cone support base 25 onto which yarn 26 is wound again to form a frustoconical outer surface but the yarn can be pulled off over end. An alternative form of spool is shown in FIG. 3 in which the support base is cylindrical in shape as indicated at 35 with a bottom flange 36 to retrain the yarn in place. The dimensions of the pegs are selected so as to receive both types of spool both as a loose fit on the peg.

Between the rows of pegs indicated at 40 and 41 in FIG. 1 there is provided a row 42 of recesses 43. These recesses thus are formed across the centre of the tray in the top surface 12 extending downwardly toward the bottom surface 13 possibly to contact the bottom surface 13. This provides structural strength for the arrangement in that the recesses prevent bending of the top surface 12 substantially horizontal and the peg thus extending vertically therefrom. The two end ones of the recesses 43 adjacent ends 45 and 46 of the tray are used as finger grasping holes. Thus a user can reach across a shelf to the tray and grasp the tray simply by placing one digit into the recess 43 adjacent the respective edge. The tray can then be carried and its stability improved for example by inserting the thumb of the carrier into the end recess at each end of the tray.

In one example the tray is of dimensions six inches by eighteen inches as this has been found to provide a suitable dimension for storage and in addition provides sufficient space between the pegs to allow storage of the largest size of the spools available generally for machines of this type.

The height of the pegs is of the order of 2.5 inches with a top diameter of the order of 13/16 inch and a bottom diameter of the order of 1.0 inches. Again this has been found to provide a suitable dimension for the storage of the spools.

Since various modifications can be made in my invention as herein above described, and many apparently widely different embodiments of same made within the spirit and scope of the claims without departing frown such spirit and scope, it is intended that all matter contained in the accompanying specification shall be interpreted as illustrative only and not in a limiting sense.

I claim:

1. A yarn spool holding tray comprising a generally horizontal planar base for resting on a support surface, a plurality of pegs upstanding from the base at spaced positions across an upper surface of the base substantially at right angles to the base each for receiving a respective one of a plurality of spools and a plurality of yarn catch means each associated with a respective peg and arranged for receiving and holding an end portion of yarn from the respective one of the spools carried on the peg, the base member being rectangular in plan view so as to define two sides and two ends at right angles to the sides, the base member having a substantially planar upper wall with the only elements of the tray which are upstanding therefrom consisting of said pegs, the base member having lower wall means generally parallel to the upper wall for resting an a horizontal support surface, the base member and the pegs being integrally molded from plastics material with the pegs having a hollow frustoconical wall closed at an upper end and interconnected with said upper wall at openings through the upper wall, said yarn catch means of each peg comprising a slit formed across the peg through the frustoconical wall at the upper end.

2. The holding tray according to claim 1 wherein there are twelve pegs.

3. The holding tray according to claim 2 wherein the twelve pegs are arranged in two rows of six pegs.

4. The holding tray according to claim 1 wherein the upper wall has two recesses molded therein, each recess being at a location on the upper wall adjacent a respective one of the ends of the base member and each recess being shaped with a substantially vertical sidewall for grasping and pulling by a finger of a user.

5. The holding tray according to claim 1 including a plurality of yarn spool cones with each cone engaged over a respective one of the pegs, each cone having a cone support body onto which a length of yarn is wound with the cone support body having a frusto-conical hollow interior and each peg having a frusto-conical outer surface generally following the interior of the cone support body, a diameter of the respective peg at the base member being less than a diameter of the cone support body at a bottom end thereof so that the cone support body is a loose fit on the respective peg.

6. A yarn spool holding tray comprising a generally horizontal planar base member for resting on a support surface, a plurality of pegs upstanding from the base at spaced positions across an upper surface of the base and including a plurality of yarn spool cones with each cone engaged over a respective one of the pegs, the base member being rectangular in plan view so as to define two sides and two ends at right angles to the sides, each cone having a cone support body onto which a length of yarn is wound with the cone support body having a frusto-conical hollow interior and each peg having a frusto-conical outer surface generally following the interior of the cone support body, a diameter of the respective peg at the base member being less than a diameter of the cone support body at a bottom end thereof so that the cone support body is a loose fit on the respective peg, the base member having a substantially planar upper wall with the only elements of the tray which are upstanding therefrom consisting of said pegs, the base member having lower wall means generally parallel to the upper wall for resting an a horizontal support surface, the base member and the pegs being integrally molded from plastics material with the pegs being hollow and interconnected with said upper wall at openings through the upper wall, the upper wall having two recesses molded therein each recess being at a location on the upper wall adjacent a respective one of the ends of the base member and each recess being shaped with a substantially vertical sidewall for grasping and pulling by a finger of a user.

* * * * *